United States Patent [19]

Yamada

[11] 4,417,731

[45] Nov. 29, 1983

[54] HOLLOW METAL GOLF CLUB HEAD AND CLUB INCORPORATING IT

[76] Inventor: Kunio Yamada, 5-14, 4 chome, Hibarigaokakita, Houya-shi, Tokyo-to, Japan

[21] Appl. No.: 389,081

[22] Filed: Jun. 16, 1982

[51] Int. Cl.[3] ..... A63B 53/04; A63B 53.08; A63B 53.02

[52] U.S. Cl. ..... 273/167 H; 272/171; 272/80.4

[58] Field of Search ..... 273/167 H, 167 E, 80.2–80.7

[56] References Cited

U.S. PATENT DOCUMENTS

| | | | |
|---|---|---|---|
| 1,501,344 | 7/1924 | Hubbard | 273/80.2 |
| 1,582,836 | 4/1926 | Link | 273/167 H |
| 1,983,158 | 12/1934 | Young | 273/80.4 |
| 4,214,754 | 7/1980 | Zebelean | 273/171 X |

FOREIGN PATENT DOCUMENTS

| | | | |
|---|---|---|---|
| 211781 | 1/1957 | Australia | 273/169 |
| 1379529 | 1/1975 | United Kingdom | 273/167 H |

*Primary Examiner*—George J. Marlo
*Attorney, Agent, or Firm*—Donald D. Mon

[57] ABSTRACT

A hollow metal golf club having a structure in which the club head has a body portion and a neck portion for attachment of a golf club handle shaft. The club head is similar in shape and size to conventional wood club heads. A metal cylinder has a socket to receive a shaft. It is supported inside the neck portion and body portion. The handle shaft is mounted by inserting it in the socket of the cylinder and fastening it there by suitable means. The bottom of the hollow club head has an opening covered by a removable plate.

12 Claims, 3 Drawing Figures

HOLLOW METAL GOLF CLUB HEAD AND CLUB INCORPORATING IT

FIELD OF THE INVENTION

This invention relates to golf clubs and more particularly relates to a hollow metal golf club head of the type sometimes called a "metal wood".

BACKGROUND OF THE INVENTION

Conventional fairway golf clubs, including drivers are, in most cases, made of wood and are usually referred to as "woods" as the name indicates. Recently, however, hollow metal club heads have been developed (so-called "metal woods") wherein they are molded in hollow form of strong material such as steel, stainless steel, etc. This metal club head has a high coefficient of restitution and lower air resistance in addition to being stronger and more durable than conventional "woods".

This club differs from wooden club heads due to the hollowness of the head. The shaft for attaching the handle to the hollow metal heads must be connected to the head at the neck head. However, the neck portion is subjected to strong flexure, compressive stress, shear stress, etc., at the moment of impact (of the head against the ball). Therefore, it must be reinforced. To provide a solid neck portion, however, creates the disadvantages of increased weight in the head and increased breakability at the base of the neck due to the strong flexing stresses etc., arising near the junction of the neck and the head.

Therefore, it is one objective of the present invention to produce an improved hollow metal golf club head.

Still another object of the present invention is to provide an improved hollow metal club head having a reinforced improved structure in the neck of the club head.

Yet another object of the present invention is to provide a hollow metal golf club head with a club face of improved structure.

SUMMARY OF THE INVENTION

An objective of the present invention is to provide an improved hollow metal club head with an improved neck portion and means for joining the handle shaft of the club head.

The hollow metal club head of the present invention is designed to make the neck portion of the club head substantially hollow so the strong flexing stresses will not be applied to the neck portion alone at the moment of impact. The hollow neck also results in the weight reduction of the club head.

The metal club head is hollow and is formed in substantially the same shape as a conventional wooden club head, having a face and a neck portion extended outward from the main body of the club head. The hollow metal club is molded of strong metal construction such as steel, stainless steel, etc., of approximately uniform thickness.

A metal cylindrical socket is supported in the neck portion of the club head by two plate-like webs securing the outer surface of the cylindrical socket with the inner surface of the neck portion. The plate-like webs are in a plane substantially parallel to the club head face which would pass through the axis of the cylindrical socket. The plate-like webs support the cylindrical socket so that there is a hollow space in the neck substantially surrounding the cylindrical socket. The internal diameter of the socket in the cylindrical piece is substantially the same diameter as the outer diameter of the shaft surrounding the club handle. The club shaft is securely mounted in the socket of the cylinder. Pins, screws or other suitable means are provided to secure the club shaft in the socket of the cylinder. The open end of the neck portion of the club head is closed and sealed by a cylindrical shank surrounding the shaft handle.

The above and other features of the invention will be fully understood from the following detailed description and the accompanying drawings, in which:

DETAILED DESCRIPTION OF THE INVENTION

Figure 1:
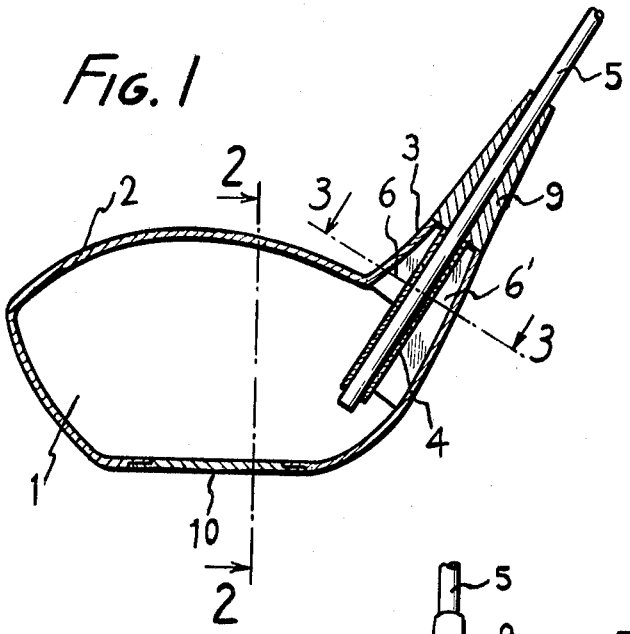
FIG. 1 is a sectional side elevation of a hollow metal club head formed according to the invention.

A hollow metal club according to the invention is indicated generally at 1 in FIG. 1, and is comprised of a hollow body 2, having a neck portion 3 which projects outward from upper end of the club head. The hollow metal club head is substantially the same size and shape as that of a conventional wooden club head and is comprised of a hollow molded head made of a metal such as steel, or stainless steel, having an approximately uniform thickness except at the face.

Figure 2:
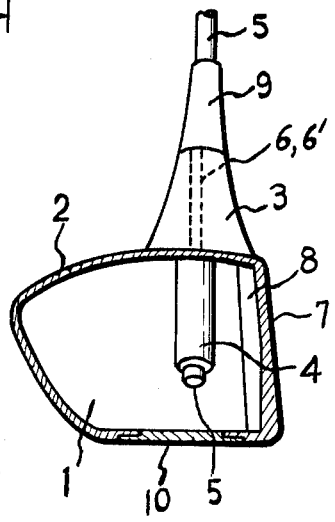
FIG. 2 is a sectional view of the hollow metal club head taken at 2—2 of FIG. 1.
Figure 3:
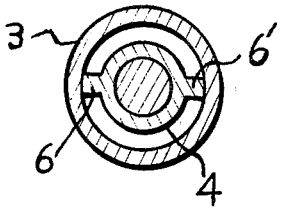
FIG. 3 is a sectional view taken through the neck portion of the hollow metal golf club head of FIG. 2 at 3—3.

A cylindrical socket 4 is positioned coaxially in the neck portion 3 so that there is an open space between the neck portion and the cylindrical socket 4. The inner diameter of the cylindrical socket 4 is substantially the same diameter as the outer diameter of the club handle shaft 5. The cylindrical socket 4 is secured in place by plate-like webs 6 and 6' formed in the space between the inner surface of the neck 3 and the outer surface of the cylindrical socket 4. The plate-like webs 6 and 6' are securely attached to the cylindrical socket 4. The plate-like webs 6 and 6' are securely attached to the cylindrical socket 4 and the neck portion 3 so that the cylindrical socket is firmly attached and supported in the neck portion. The plate-like webs 6 and 6' are positioned so that their planar surfaces are substantially parallel with the face of the club head as shown on FIG. 2 and coplanar with the axis of the cylindrical socket 4.

As stated previously, the hollow metal club is molded of a strong metal such as steel, or stainless steel, having over most of its surface an approximately uniform thickness except in the area of the club face which is approximately twice the thickness of the rest of the club head in the upper portion of the club face and tapers outward to a slightly greater thickness in he lower portion of the club face as illustrated at 7'. The club face 7 is further reinforced by a plurality of vertically positioned, equally spaced stiffening ribs 8.

The golf club handle shaft 5 is secured to the hollow metal club head constructed as described above by inserting the handle shaft 5 into the cylindrical socket 4. The shaft is then secured by pins, screws or other suitable means driven from the outer surface of the cylindrical socket through the wall into the shaft. The open end of the neck 3 is closed by means of a shank socket 9 surrounding the handle shaft 5 and secured to the neck of the club head 2.

The open area at the bottom of the club head is closed by means of sole-plate 10 attached by screws, adhesive or any other suitable means. Preferably the bottom sole-plate 10 is freely attachable and detachable for adjustments to the head.

The hollow metal golf club head disclosed and described above has reduced air resistance and a greater coefficient of restitution relative to a golf ball than a conventional "wood", thereby providing increased distance. Thus, driving distances with this club head can be increased significantly. An additional advantage of the hollow metal club head is its strength and the fact that the club face or other areas of the club head are not easily damaged, thereby substantially increasing the durability of the club. Furthermore, the method of supporting the handle shaft 5, inserted and fastened in the cylindrical socket 4 supported by the ribs insulates the neck portion from stresses occurring at the club face at impact, from being directly conveyed to the neck portion. This construction spreads and decreases the external forces from such stresses as flexure etc. around the neck portion in a manner similar to that of conventional wooden club heads notwithstanding the fact that is is hollow. The club face on the hollow metal club head of the present invention is remarkably stronger, and the entire head can be made lighter, in comparisong to a conventional wood or other hollow metal heads which have a solid neck portion.

Another advantage is that the detachable bottom plate allows the removal or replacement of fillings in the hollow club head for arresting the sound at time of impact. Further the detachable bottom plate allows removal and repair of metal flaked off the inside of the metal face if any. Additionally, the hollow metal head permits the addition of lead pieces for weight adjustment and center of gravity adjustment which are usually fixed to the surface of a wooden club head. With the hollow club head of the present invention these pieces can be positioned inside the head by detaching the bottom plate thereby improving the overall appearance of the club head and reducing the air resistance. The invention described as above will provide this and other practical improved effects.

It will be observed that this club head is easily reshafted to change the swing weight as desired. It is merely necessary to pull the pin or remove whatever fastener means is used, and substitute one shaft for another. Prior art club heads, which were filled with foam had to be heated to release the shaft from the hosel, which destroyed the foam.

This club head can readily be made by an investment casting procedure, which can form integral ribs that do not have to be welded in place, and apertures in the socket means of sufficient accuracy that drilling or further finishing is unnecessary.

Thus, it is possible to make a metal club head having a conventional envelope and correct weight, in contrast with prior efforts at making metal heads, wherein the head was made smaller in an effort to lighten the club while still providing sufficient strength to resist impact loads at the hosel.

This invention is not to be limited by the embodiments shown in the drawings and described in the description, which are given by way of example and not of limitation, but only in accordance with the scope of the appended claims.

I claim:

1. A golf club head comprising: a hollow metal body portion having an external shape substantially similar to a conventional "wood", said head further including a hollow neck portion extending from said body portion, cylindrical socket means extending from said body portion, cylindrical socket means extending into said portions, a plurality of web means attached to and interconnecting said socket means and said neck portion to support said socket means, with a spacing extending substantially around said socket means, said socket means having an aperture aligned with said neck portion to receive a shaft.

2. A golf club head according to claim 1 in which said club head has a face, said web means extending substantially parallel to said face.

3. A golf club head according to claim 1 in which said club head is molded from stainless steel.

4. A golf club head according to claim 1 in which said club head has a face, said face being substantially thicker than the rest of said club head.

5. A golf club head according to claim 4 including a plurality of stiffening ribs behind said face for reinforcing and strengthening said face.

6. A golf club head according to claim 4 in which said club face has an upper portion and lower portion; said lower portion having a thickness greater than the upper portion.

7. A golf club head according to claim 1 in which the bottom of said club head is open whereby adjustments may be made to the weight and center of gravity of said club head by adding filler.

8. A golf club head according to claim 7 including a detachable plate for closing the bottom portion of said club head.

9. A golf club head according to claim 1 in which said web means also interconnects said socket member to said body portion.

10. A golf club head according to claim 1 in which said web means are plate-like.

11. In combination, a golf club head according to claim 1, and a shaft having a diameter approximately equal to the diameter of said aperture, inserted into and retained in said aperture.

12. A combination according to claim 11 in which said web means are plate-like, and also interconnect said socket memeber and said body portion.

* * * * *